US010487590B2

(12) United States Patent
Schroder et al.

(10) Patent No.: US 10,487,590 B2
(45) Date of Patent: Nov. 26, 2019

(54) CUTTING ELEMENT ASSEMBLIES AND DOWNHOLE TOOLS COMPRISING ROTATABLE CUTTING ELEMENTS AND RELATED METHODS

(71) Applicant: Baker Hughes, a GE company, LLC, Houston, TX (US)

(72) Inventors: Jon David Schroder, The Woodlands, TX (US); John Abhishek Raj Bomidi, Spring, TX (US); Alexander Rodney Boehm, Wheat Ridge, CO (US); Kegan L. Lovelace, Houston, TX (US); William A. Moss, Jr., Conroe, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 205 days.

(21) Appl. No.: 15/663,530

(22) Filed: Jul. 28, 2017

(65) Prior Publication Data

US 2019/0032418 A1 Jan. 31, 2019

(51) Int. Cl.

| | |
|---|---|
| ***E21B 10/62*** | (2006.01) |
| ***E21B 10/43*** | (2006.01) |
| ***E21B 10/55*** | (2006.01) |
| ***E21B 10/573*** | (2006.01) |
| *E21B 10/42* | (2006.01) |
| *E21B 10/567* | (2006.01) |

(52) U.S. Cl.

CPC ..... *E21B 10/62* (2013.01); *E21B 10/43* (2013.01); *E21B 10/55* (2013.01); *E21B 10/573* (2013.01); *E21B 10/567* (2013.01); *E21B 2010/425* (2013.01)

(58) Field of Classification Search

CPC ..... E21B 10/62
USPC ..... 175/428
See application file for complete search history.

(56) References Cited

U.S. PATENT DOCUMENTS

| | | | |
|---|---|---|---|
| 4,553,615 | A | 11/1985 | Grainger |
| 4,751,972 | A | 6/1988 | Jones et al. |
| 7,604,073 | B2 | 10/2009 | Cooley et al. |
| 7,703,559 | B2 | 4/2010 | Shen et al. |
| 7,762,359 | B1 | 7/2010 | Miess |
| 7,845,436 | B2 | 12/2010 | Cooley et al. |

(Continued)

OTHER PUBLICATIONS

International Written Opinion for International Application No. PCT/US2018/043737 dated Oct. 15, 2018, 5 pages.

(Continued)

*Primary Examiner* — Taras P Bemko
(74) *Attorney, Agent, or Firm* — TraskBritt

(57) ABSTRACT

A cutting element assembly includes a rotatable cutting element, a sleeve having a cutter receiving aperture extending at least partially through the sleeve and configured to receive at least a portion of the rotatable cutting element within the cutter-receiving aperture, and a retention element rotatably coupling the rotatable cutting element to the sleeve. In some embodiments, the retention element includes a pin extending from a base portion of the sleeve and having at least one resilient portion having at least one protrusion radially extending outward. In additional embodiments, the retention element include a split ring or O-ring disposed within a groove of the rotatable cutting element. Earth-boring tools having rotating cutting elements are also disclosed.

20 Claims, 7 Drawing Sheets

(56) References Cited

U.S. PATENT DOCUMENTS

| | | | |
|---|---|---|---|
| 7,987,931 | B2 | 8/2011 | Cooley et al. |
| 8,061,452 | B2 | 11/2011 | Cooley et al. |
| 8,079,431 | B1 | 12/2011 | Cooley et al. |
| 8,091,655 | B2 | 1/2012 | Shen et al. |
| 8,210,285 | B2 | 7/2012 | Cooley et al. |
| 8,413,746 | B2 | 4/2013 | Shen et al. |
| 8,561,728 | B2 | 10/2013 | Cooley et al. |
| 8,800,691 | B2 | 8/2014 | Shen et al. |
| 8,881,849 | B2 | 11/2014 | Shen et al. |
| 8,931,582 | B2 | 1/2015 | Cooley et al. |
| 8,950,516 | B2 | 2/2015 | Newman |
| 8,973,684 | B1 | 3/2015 | Cooley et al. |
| 8,991,523 | B2 | 3/2015 | Shen et al. |
| 9,016,409 | B2 | 4/2015 | Zhang et al. |
| 9,033,070 | B2 | 5/2015 | Shen et al. |
| 9,187,962 | B2 | 11/2015 | Burhan et al. |
| 9,279,294 | B1 | 3/2016 | Cooley et al. |
| 9,291,000 | B2 | 3/2016 | Zhang et al. |
| 9,322,219 | B2 | 4/2016 | Burhan et al. |
| 9,328,564 | B2 | 5/2016 | Zhang et al. |
| 9,382,762 | B2 | 7/2016 | Cooley et al. |
| 9,388,639 | B2 | 7/2016 | Patel et al. |
| 9,464,486 | B2 | 10/2016 | Zhang et al. |
| 9,605,486 | B2 | 3/2017 | Burhan et al. |
| 2008/0202814 | A1 | 8/2008 | Lyons et al. |
| 2008/0251293 | A1 | 10/2008 | Mumma et al. |
| 2012/0160562 | A1 | 6/2012 | Ugwuocha et al. |
| 2012/0273281 | A1 | 11/2012 | Burhan et al. |
| 2014/0054094 | A1* | 2/2014 | Burhan ..... E21B 10/50 175/354 |
| 2014/0131118 | A1 | 5/2014 | Chen et al. |
| 2014/0182949 | A1 | 7/2014 | Thigpen |
| 2014/0326515 | A1 | 11/2014 | Shi et al. |
| 2014/0326516 | A1 | 11/2014 | Haugvaldstad et al. |
| 2014/0360789 | A1 | 12/2014 | Siracki et al. |
| 2014/0360792 | A1 | 12/2014 | Azar et al. |
| 2015/0047910 | A1 | 2/2015 | Chen et al. |
| 2016/0273273 | A1 | 9/2016 | Hinz et al. |
| 2016/0290056 | A1 | 10/2016 | Propes et al. |

OTHER PUBLICATIONS

International Search Report for International Application No. PCT/US2018/043737 dated Oct. 15, 2018, 2 pages.

* cited by examiner

CUTTING ELEMENT ASSEMBLIES AND DOWNHOLE TOOLS COMPRISING ROTATABLE CUTTING ELEMENTS AND RELATED METHODS

FIELD

Embodiments of the present disclosure relate generally to rotatable cutting elements and earth-boring tools having such cutting elements, as well as related methods of forming downhole tools.

BACKGROUND

Wellbores are formed in subterranean formations for various purposes including, for example, extraction of oil and gas from the subterranean formation and extraction of geothermal heat from the subterranean formation. Wellbores may be formed in a subterranean formation using a drill bit, such as an earth-boring rotary drill bit. Different types of earth-boring rotary drill bits are known in the art, including fixed-cutter bits (which are often referred to in the art as "drag" bits), rolling-cutter bits (which are often referred to in the art as "rock" bits), diamond-impregnated bits, and hybrid bits (which may include, for example, both fixed cutters and rolling cutters). The drill bit is rotated and advanced into the subterranean formation. As the drill bit rotates, the cutters or abrasive structures thereof cut, crush, shear, and/or abrade away the formation material to form the wellbore. A diameter of the wellbore drilled by the drill bit may be defined by the cutting structures disposed at the largest outer diameter of the drill bit.

The drill bit is coupled, either directly or indirectly, to an end of what is referred to in the art as a "drill string," which comprises a series of elongated tubular segments connected end-to-end that extends into the wellbore from the surface of earth above the subterranean formations being drilled. Various tools and components, including the drill bit, may be coupled together at the distal end of the drill string at the bottom of the wellbore being drilled. This assembly of tools and components is referred to in the art as a "bottom hole assembly" (BHA).

The drill bit may be rotated within the wellbore by rotating the drill string from the surface of the formation, or the drill bit may be rotated by coupling the drill bit to a downhole motor, which is also coupled to the drill string and disposed proximate the bottom of the wellbore. The downhole motor may include, for example, a hydraulic Moineau-type motor having a shaft, to which the drill bit is mounted, that may be caused to rotate by pumping fluid (e.g., drilling mud or fluid) from the surface of the formation down through the center of the drill string, through the hydraulic motor, out from nozzles in the drill bit, and back up to the surface of the formation through the annular space between the outer surface of the drill string and the exposed surface of the formation within the wellbore. The downhole motor may be operated with or without drill string rotation.

A drill string may include a number of components in addition to a downhole motor and drill bit including, without limitation, drill pipe, drill collars, stabilizers, measuring while drilling (MWD) equipment, logging while drilling (LWD) equipment, downhole communication modules, and other components.

In addition to drill strings, other tool strings may be disposed in an existing well bore for, among other operations, completing, testing, stimulating, producing, and remediating hydrocarbon-bearing formations.

Cutting elements used in earth boring tools often include polycrystalline diamond compact (often referred to as "PDC") cutting elements, which are cutting elements that include so-called "tables" of a polycrystalline diamond material mounted to supporting substrates and presenting a cutting face for engaging a subterranean formation. Polycrystalline diamond (often referred to as "PCD") material is material that includes inter-bonded grains or crystals of diamond material. In other words, PCD material includes direct, intergranular bonds between the grains or crystals of diamond material.

Cutting elements are typically mounted on body a drill bit by brazing. The drill bit body is formed with recesses therein, commonly termed "pockets," for receiving a substantial portion of each cutting element in a manner that presents the PCD layer at an appropriate back rake and side rake angle, facing in the direction of intended bit rotation, for cutting in accordance with the drill bit design. In such cases, a brazing compound is applied between the surface of the substrate of the cutting element and the surface of the recess on the bit body in which the cutting element is received. The cutting elements are installed in their respective recesses in the bit body, and heat is applied to each cutting element via a torch to raise the temperature to a point high enough to braze the cutting elements to the bit body in a fixed position but not so high as to damage the PCD layer.

Unfortunately, securing a PDC cutting element to a drill bit restricts the useful life of such cutting element, because the cutting edge of the diamond table and the substrate wear down, creating a so-called "wear flat" and necessitating increased weight-on-bit to maintain a given rate of penetration of the drill bit into the formation due to the increased surface area presented. In addition, unless the cutting element is heated to remove it from the bit and then re-brazed with an unworn portion of the cutting edge presented for engaging a formation, more than half of the cutting element is never used.

Rotatable cutting elements mounted for rotation about a longitudinal axis of the cutting element can wear more evenly than fixed cutting elements, and exhibit a significantly longer useful life without removal from the drill bit. That is, as a cutting element rotates in a bit body, different parts of the cutting edges or surfaces may be exposed at different times, such that more of the cutting element is used. Thus, rotatable cutting elements may have a longer life than fixed cutting elements.

BRIEF SUMMARY

Some embodiments of the present disclosure include cutting element assemblies for a downhole tool. The cutting element assemblies may include a rotatable cutting element, a sleeve, and a retention element. The sleeve may include a cutter-receiving aperture extending at least partially through the sleeve and configured to receive at least a portion of the rotatable cutting element within the cutter-receiving aperture. The retention element may rotatably couple the rotatable cutting element to the sleeve.

Further embodiments of the present disclosure include downhole tools. The downhole tools may include a bit body, at least one blade extending from the bit body, at least one sleeve, at least one rotatable cutting element, and a retention element. The at least one sleeve may be secured to the at least one blade and may define a cutter-receiving aperture. The at least one rotatable cutting element may be disposed within the cutter-receiving aperture of the at least one sleeve.

The retention element may rotatably couple the at least one rotatable cutting element to the at least one sleeve.

Additional embodiments of the present disclosure include methods of forming downhole tools. The methods may include forming a bit body that includes at least one blade extending from the bit body; securing at least one sleeve to the at least one blade, the at least one sleeve defining a cutter-receiving aperture; and rotatably coupling a rotatable cutting element within the cutter-receiving aperture of the at least one sleeve with a retention element.

DETAILED DESCRIPTION

Figure 1:
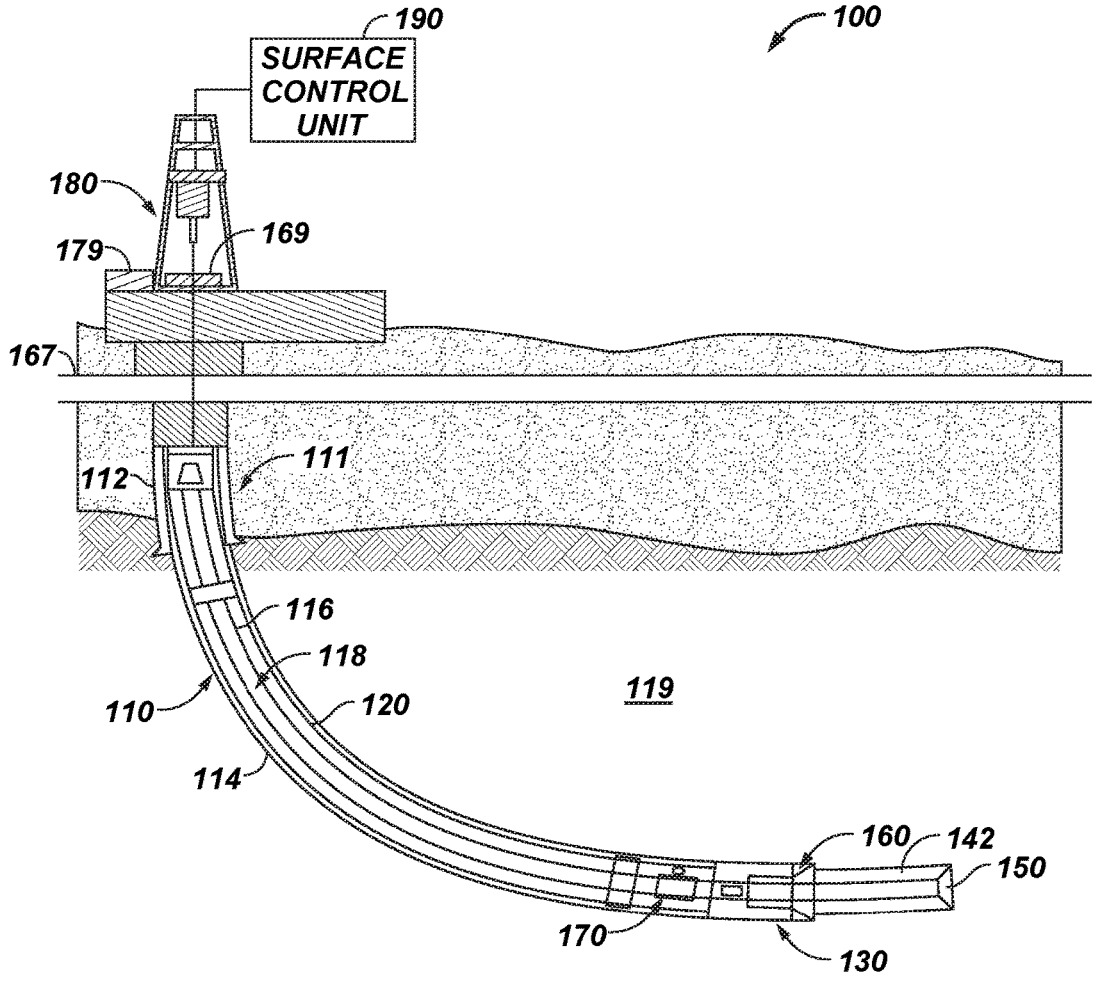
FIG. 1 is a simplified schematic diagram of an example of a drilling system using cutting element assemblies according to one or more embodiments of the present disclosure.

The illustrations presented herein are not actual views of any particular cutting assembly, tool, or drill string, but are merely idealized representations employed to describe example embodiments of the present disclosure. The following description provides specific details of embodiments of the present disclosure in order to provide a thorough description thereof. However, a person of ordinary skill in the art will understand that the embodiments of the disclosure may be practiced without employing many such specific details. Indeed, the embodiments of the disclosure may be practiced in conjunction with conventional techniques employed in the industry. In addition, the description provided below does not include all elements to form a complete structure or assembly. Only those process acts and structures necessary to understand the embodiments of the disclosure are described in detail below. Additional conventional acts and structures may be used. Also note, any drawings accompanying the application are for illustrative purposes only, and are thus not drawn to scale. Additionally, elements common between figures may have corresponding numerical designations.

As used herein, the terms "comprising," "including," "containing," "characterized by," and grammatical equivalents thereof are inclusive or open-ended terms that do not exclude additional, un-recited elements or method steps, but also include the more restrictive terms "consisting of," "consisting essentially of," and grammatical equivalents thereof.

As used herein, the term "may" with respect to a material, structure, feature, or method act indicates that such is contemplated for use in implementation of an embodiment of the disclosure, and such term is used in preference to the more restrictive term "is" so as to avoid any implication that other compatible materials, structures, features, and methods usable in combination therewith should or must be excluded.

As used herein, the term "configured" refers to a size, shape, material composition, and arrangement of one or more of at least one structure and at least one apparatus facilitating operation of one or more of the structure and the apparatus in a predetermined way.

As used herein, the singular forms following "a," "an," and "the" are intended to include the plural forms as well, unless the context clearly indicates otherwise.

As used herein, the term "and/or" includes any and all combinations of one or more of the associated listed items.

As used herein, spatially relative terms, such as "below," "lower," "bottom," "above," "upper," "top," and the like, may be used for ease of description to describe one element's or feature's relationship to another element(s) or feature(s) as illustrated in the figures. Unless otherwise specified, the spatially relative terms are intended to encompass different orientations of the materials in addition to the orientation depicted in the figures.

As used herein, the term "substantially" in reference to a given parameter, property, or condition means and includes to a degree that one of ordinary skill in the art would understand that the given parameter, property, or condition is met with a degree of variance, such as within acceptable manufacturing tolerances. By way of example, depending on the particular parameter, property, or condition that is substantially met, the parameter, property, or condition may be at least 90.0% met, at least 95.0% met, at least 99.0% met, or even at least 99.9% met.

As used herein, the term "about" used in reference to a given parameter is inclusive of the stated value and has the meaning dictated by the context (e.g., it includes the degree of error associated with measurement of the given parameter).

As used herein, the term "hard material" means and includes any material having a Knoop hardness value of about 1,000 $kg/mm^2$ (9,807 MPa) or more. Hard materials include, for example, diamond, cubic boron nitride, boron carbide, tungsten carbide, etc.

As used herein, the term "intergranular bond" means and includes any direct atomic bond (e.g., covalent, metallic, etc.) between atoms in adjacent grains of material.

As used herein, the term "polycrystalline hard material" means and includes any material comprising a plurality of grains or crystals of the material that are bonded directly together by intergranular bonds. The crystal structures of the individual grains of polycrystalline hard material may be randomly oriented in space within the polycrystalline hard material.

As used herein, the term "earth-boring tool" means and includes any type of bit or tool used for drilling during the formation or enlargement of a wellbore and includes, for example, rotary drill bits, percussion bits, core bits, eccentric bits, bi-center bits, reamers, mills, drag bits, roller-cone bits, hybrid bits, and other drilling bits and tools known in the art.

FIG. 1 is a schematic diagram of an example of a drilling system 100 using cutting element assemblies disclosed herein. FIG. 1 shows a wellbore 110 that may include an upper section 111 with a casing 112 installed therein and a lower section 114 that is being drilled with a drill string 118. The drill string 118 may include a tubular member 116 that carries a drilling assembly 130 at its bottom end. The tubular member 116 may be coiled tubing or may be formed by joining drill pipe sections. A drill bit 150 (also referred to as the "pilot bit") may be attached to the bottom end of the drilling assembly 130 for drilling a first, smaller diameter borehole 142 in the formation 119. A reamer 160 may be placed above or uphole of the drill bit 150 in the drill string to enlarge the borehole 142 to a second, larger diameter borehole 120. The terms wellbore and borehole are used herein as synonyms.

The drill string 118 may extend to a rig 180 at the surface 167. The rig 180 shown is a land rig for ease of explanation. The apparatus and methods disclosed herein equally apply when an offshore rig is used for drilling underwater. A rotary table 169 or a top drive may rotate the drill string 118 and the drilling assembly 130, and thus the pilot bit 150 and reamer bit 160, to respectively form boreholes 142 and 120. The rig 180 may also include conventional devices, such as mechanisms to add additional sections to the tubular member 116 as the wellbore 110 is drilled. A surface control unit 190, which may be a computer-based unit, may be placed at the surface for receiving and processing downhole data transmitted by the drilling assembly 130 and for controlling the operations of the various devices and sensors 170 in the drilling assembly 130. A drilling fluid from a source 179 thereof is pumped under pressure through the tubular member 116 that discharges at the bottom of the pilot bit 150 and returns to the surface via the annular space (also referred to as the "annulus") between the drill string 118 and an inside wall of the wellbore 110.

During operation, when the drill string 118 is rotated, both the pilot bit 150 and the reamer bit 160 may rotate. The pilot bit 150 drills the first, smaller diameter borehole 142, while simultaneously the reamer bit 160 enlarges the borehole 142 to a second, larger diameter 120. The earth's subsurface formation may contain rock strata made up of different rock structures that can vary from soft formations to very hard formations, and therefore the pilot bit 150 and/or the reamer bit 160 may be selected based on the formations expected to be encountered in a drilling operation.

Figure 2:
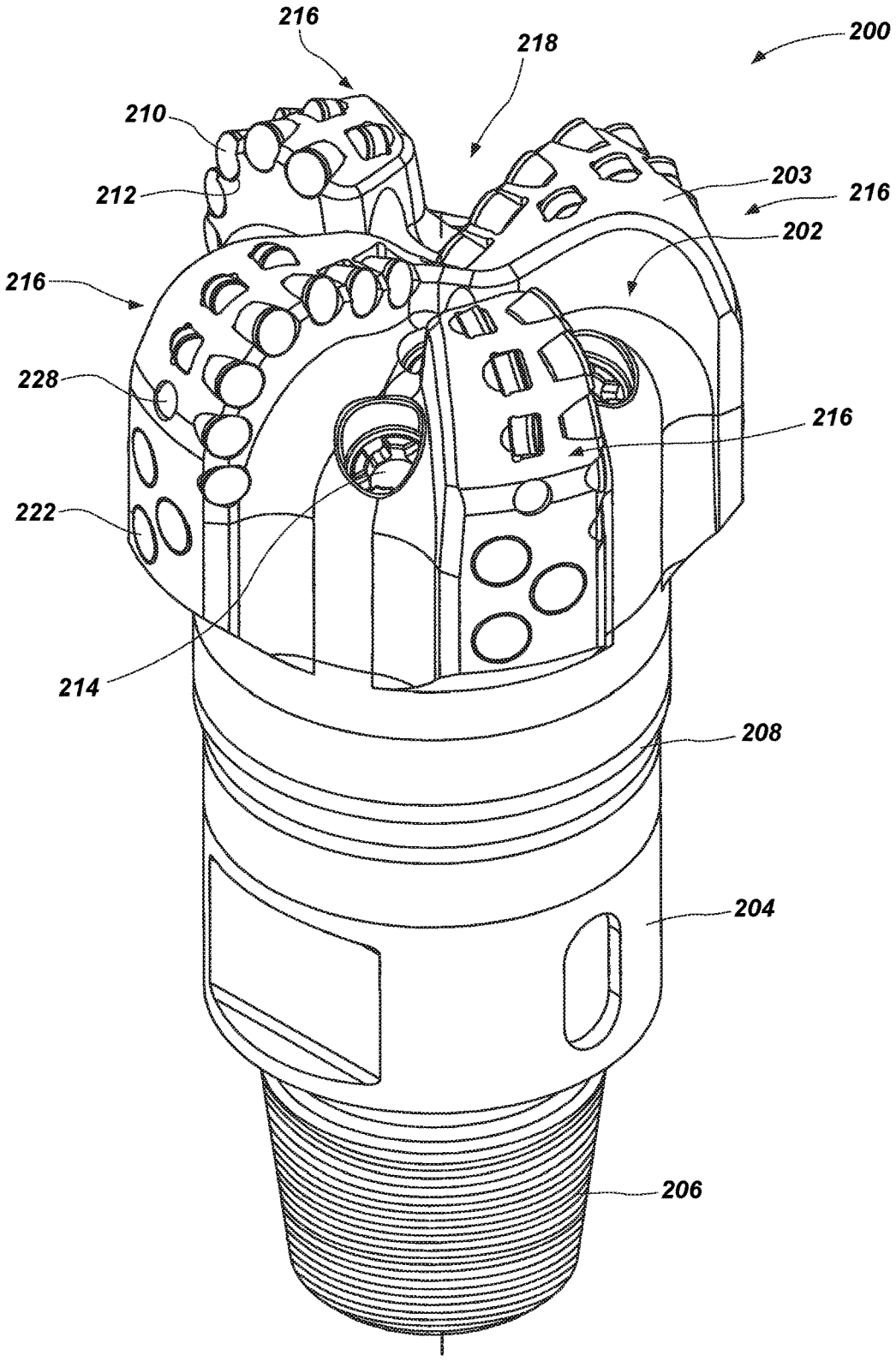
FIG. 2 is a simplified perspective view of a fixed-blade earth-boring rotary drill bit that may be used in conjunction with the drilling system of FIG. 1.

FIG. 2 is a perspective view of a fixed-cutter earth-boring rotary drill bit 200 that may be used in conjunction with the drilling system 100 of FIG. 1. For example, the drill bit 200 may be the pilot bit 150 shown in FIG. 1. The drill bit 200 includes a bit body 202 that may be secured to a shank 204 having a threaded connection portion 206 (e.g., an American Petroleum Institute (API) threaded connection portion) for attaching the drill bit 200 to a drill string (e.g., drill string 118, shown in FIG. 1). In some embodiments, the bit body 202 may be secured to the shank 204 using an extension 208. In other embodiments, the bit body 202 may be secured directly to the shank 204.

The bit body 202 may include internal fluid passageways that extend between the face 203 of the bit body 202 and a longitudinal bore, extending through the shank 204, the extension 208, and partially through the bit body 202. Nozzle inserts 214 also may be provided at the face 203 of the bit body 202 within the internal fluid passageways. The bit body 202 may further include a plurality of blades 216 that are separated by junk slots 218. In some embodiments, the bit body 202 may include gage wear plugs 222 and wear knots 228. A plurality of cutting element assemblies 210 may be mounted on the face 203 of the bit body 202 in cutting element pockets 212 that are located along each of the blades 216. The cutting element assemblies 210 may include PDC cutting elements, or may include other cutting elements. For example, some or all of the cutting element assemblies 210 may include rotatable cutting elements, as described below and shown in FIGS. 3A-5C.

Figure 3A:
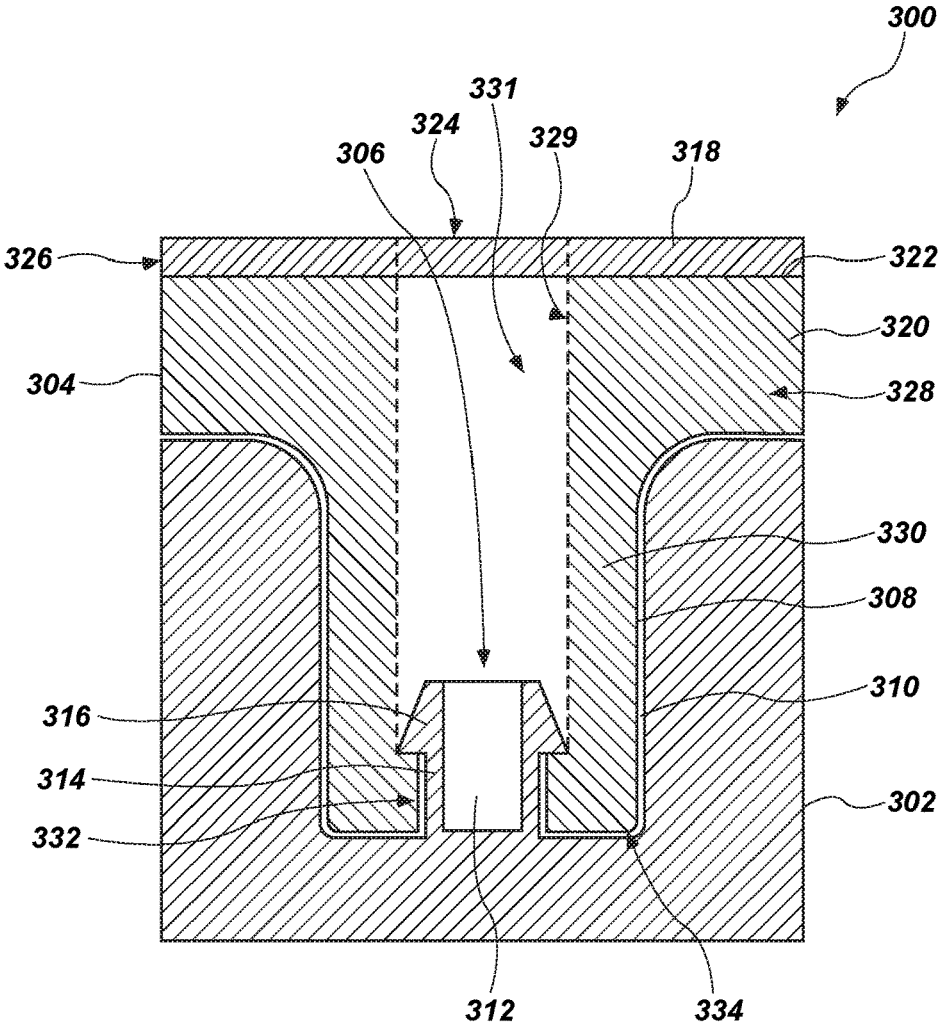
FIGS. 3A and 3C are side cross-sectional views of a cutting element assembly in differing orientations and according to one or more embodiments of the present disclosure.

FIG. 3A is a side cross-sectional view of a cutting element assembly 300 that can be mounted in a blade of an earth-boring tool. The blade may be, for example, one of the blades 216 shown in FIG. 2. The cutting element assembly 300 may be one of the cutting element assemblies 210 shown in FIG. 2. Furthermore, as described briefly above, the cutting element assembly 300 may be inserted into a cutting element pocket of the blade.

In some embodiments, the cutting element assembly 300 may include a sleeve 302, a rotatable cutting element 304 at least partially disposed within the sleeve 302, and a retention element 306 for rotatably coupling the rotatable cutting element 304 to the sleeve 302. As discussed above, the sleeve 302 may be secured to the blade. For example, the sleeve 302 may be brazed or welded within a pocket of the blade. In other embodiments, the sleeve 302 may be integrally formed with the blade, such that there is no physical interface between the sleeve 302 and the blade.

The sleeve 302 may include a first generally cylindrical interior surface 308 defining a cutter-receiving aperture 310 extending at least partially through the sleeve 302. Additionally, the cutter-receiving aperture 310 may be sized and shaped to receive at least a portion of the rotatable cutting element 304. In one or more embodiments, the cutter-receiving aperture 310 may extend only partially through the sleeve 302 (i.e., the cutter-receiving aperture 310 may define a pocket). In other embodiments, the cutter-receiving aperture 310 may extend completely through the sleeve 302.

When the cutter-receiving aperture 310 extends only partially through the sleeve 302, in one or more embodiments, the sleeve 302 may include a pin 312 extending from a base portion (e.g., a bottom portion of a pocket) of the sleeve 302. In some instances, the pin 312 may have a generally cylindrical shape and may extend axially along a central longitudinal axis of the sleeve 302. The pin 312 may include one or more resilient portions 314 (e.g., finger members) extending from the base portion of the sleeve 302 to a longitudinal end portion of the pin 312 (i.e., an end portion opposite the base portion of the sleeve 302). As used herein, the term "resilient," when used in reference to resilient portions 314, may indicate that the resilient portions 314 at least partially resist deformation, and upon being deformed from a first position to a second position, the resilient portions 314 at least substantially return to the first position. For example, the resilient portions 314 may have an extended position and a retracted position.

In some instances, the one or more resilient portions 314 may be in an extended position when the one or more resilient portions 314 extend in a direction generally parallel to the central longitudinal axis of the sleeve 302. For example, the one or more resilient portions 314 may be in an extended position in the absence of external forces. On the other hand, the one or more resilient portions 314 may be in a retracted position when the one or more resilient portions 314 are deformed (e.g., bent and/or subjected to external forces) toward the central longitudinal axis of the sleeve 302.

Furthermore, each resilient portion 314 of the one or more resilient portions 314 may include at least one protrusion 316 radially extending outward from the respective resilient portion 314. For example, each protrusion 316 of each resilient portion 314 may extend away from the central longitudinal axis of the sleeve 302. In some embodiments, each protrusion 316 may have a generally truncated-triangle cross-sectional shape when viewed from a plane extending along the central longitudinal axis of the sleeve 302 (i.e., the view depicted in FIG. 3A). In other embodiments, each protrusion 316 may have a generally circular shape, a generally rectangular shape, or any other geometric shape. In view of the foregoing, and as a non-limiting example, the one or more resilient portions 314 and respective protrusions 316 may comprise a collet fastener.

Referring still to FIG. 3A, the rotatable cutting element 304 may include a polycrystalline hard material 318 bonded to a substrate 320 at an interface 322. In other embodiments, the rotatable cutting element 304 may be formed entirely of the polycrystalline hard material 318, or may have another material in addition to the polycrystalline hard material 318 and the substrate 320. The polycrystalline hard material 318 may include diamond, cubic boron nitride, or another hard material, for example. The substrate 320 may include, for example, cobalt-cemented tungsten carbide or another carbide material.

The polycrystalline hard material 318 may have an end cutting surface 324, and may also have other surfaces, such as a side surface 326, a chamfer, etc., which surfaces may be cutting surfaces intended to contact a subterranean formation. The polycrystalline hard material 318 may be generally cylindrical, and the interface 322 may be generally parallel to the end cutting surface 324.

The substrate 320 may have a first generally cylindrical portion 328 and a second generally cylindrical portion 330. In some embodiments, the second generally cylindrical portion 330 may have a smaller outer diameter than the first generally cylindrical portion 328. Additionally, in one or more embodiments, the first generally cylindrical portion 328 may have an outer diameter that is at least substantially the same as an outer diameter of the sleeve 302. The substrate 320 may have a back surface 334 at least substantially parallel to the end cutting surface 324 of the polycrystalline hard material 318 and/or to the interface 322 between the polycrystalline hard material 318 and the substrate 320.

The rotatable cutting element 304 may also include a second generally cylindrical interior surface 329 defining a pin-receiving aperture 331 extending at least partially through the substrate 320 of the rotatable cutting element 304. In some embodiments, the pin-receiving aperture 331 may extend from the back surface 334 of the substrate 320 and completely through the substrate 320 of the rotatable cutting element 304. In further embodiments, the pin-receiving aperture 331 may also extend through the polycrystalline hard material 318 of the rotatable cutting element 304. In additional embodiments, the pin-receiving aperture 331 may extend only partially through the substrate 320 of the rotatable cutting element 304. In particular, the pin-receiving aperture 331 may defined a pocket (e.g., cavity) in the substrate 320 of the rotatable cutting element 304.

Furthermore, the second generally cylindrical interior surface 329 may define a lip 332 extending radially inward from the second generally cylindrical interior surface 329 (i.e., the inner surface of the pin-receiving aperture 331). In some instances, the lip 332 may be defined by a transition from a relatively wider portion of the pin-receiving aperture 331 to a relatively narrower portion of the pin-receiving aperture 331. In other instances, the lip 332 may include a continuous or discontinuous isolated raised body extending around and on the second generally cylindrical interior surface 329. For example, the lip 332 may include a raised ring extending inward from the second generally cylindrical interior surface 329. Regardless, the lip 332 may be sized and shaped to engage the protrusions 316 of the resilient portions 314 of the pin 312 in order to rotatably couple to the rotatable cutting element 304 to the sleeve 302. For example, when the cutting element assembly 300 is assembled, the pin 312 may extend into the pin-receiving aperture 331 of the rotatable cutting element 304. Moreover, the protrusions 316 of the resilient portions 314 of the pin 312 may engage (e.g., abut against) the lip 332 of second generally cylindrical interior surface 329 of the rotatable cutting element 304.

By engaging the lip 332 of the second generally cylindrical interior surface 329 of the rotatable cutting element 304, the protrusions 316 of the resilient portions 314 of the pin 312 may rotatably couple the rotatable cutting element 304 to the sleeve 302. In particular, the protrusions 316 of the resilient portions 314 of the pin 312 may retain the rotatable cutting element 304 to the sleeve 302 via mechanical interference with the lip 332 of the second generally cylindrical interior surface 329 of the rotatable cutting element 304. Furthermore, because the protrusions 316 may contact the lip 332 (i.e., form a bearing interface), the rotatable cutting element 304 may rotate about an axis generally collinear with the central longitudinal axis of the sleeve 302. For example, the rotatable cutting element 304 may rotate about pin 312. In some instances, the rotatable cutting element 304 may passively rotate about the pin 312 when subjected to an external force (e.g., as a result of contacting a formation).

In some embodiments, the back surface 334 and an outer surface of the second cylindrical portion 330 of the substrate 320 and the interior surface 308 of the sleeve 302 may together partially define a void between the substrate 320 and the sleeve 302. This void may prevent compressive longitudinal loads (or longitudinal components of loads) on the rotatable cutting element 304 from being transferred to the sleeve 302 through the interior surface 308 (e.g., because there may not be contact between the interior surface 308 of the sleeve 302 and the back surface 334 or outer surface of the second cylindrical portion 330 of the substrate 320). Instead, compressive longitudinal loads may be transferred substantially via the bearing interface at which the lip 332 of the second generally cylindrical interior surface 329 of the rotatable cutting element 304 contacts the protrusions 316 of the pin 312 secured to the sleeve 302.

Figure 3B:
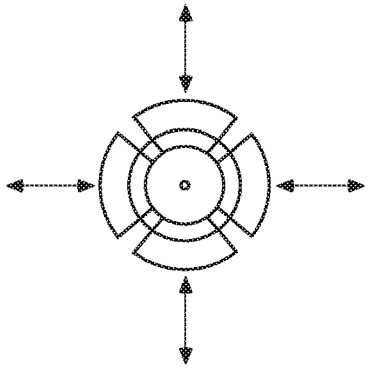
FIG. 3B is a top view of a retention element for rotatably coupling a rotatable cutting element to a sleeve of a cutting element assembly according to one or more embodiments of the present disclosure.

FIG. 3B is a top view of a pin 312 of a sleeve (e.g., sleeve 302) according to one or more embodiments of the present disclosure. As shown, the pin 312 may include a plurality of protrusions 316 (e.g., four, five, six, seven, or more) radially extending outward from a plurality of resilient portions 314. Furthermore, in some embodiments, the plurality of protrusions 316 may be oriented relative to one another in a generally circular shape.

Figure 3C:
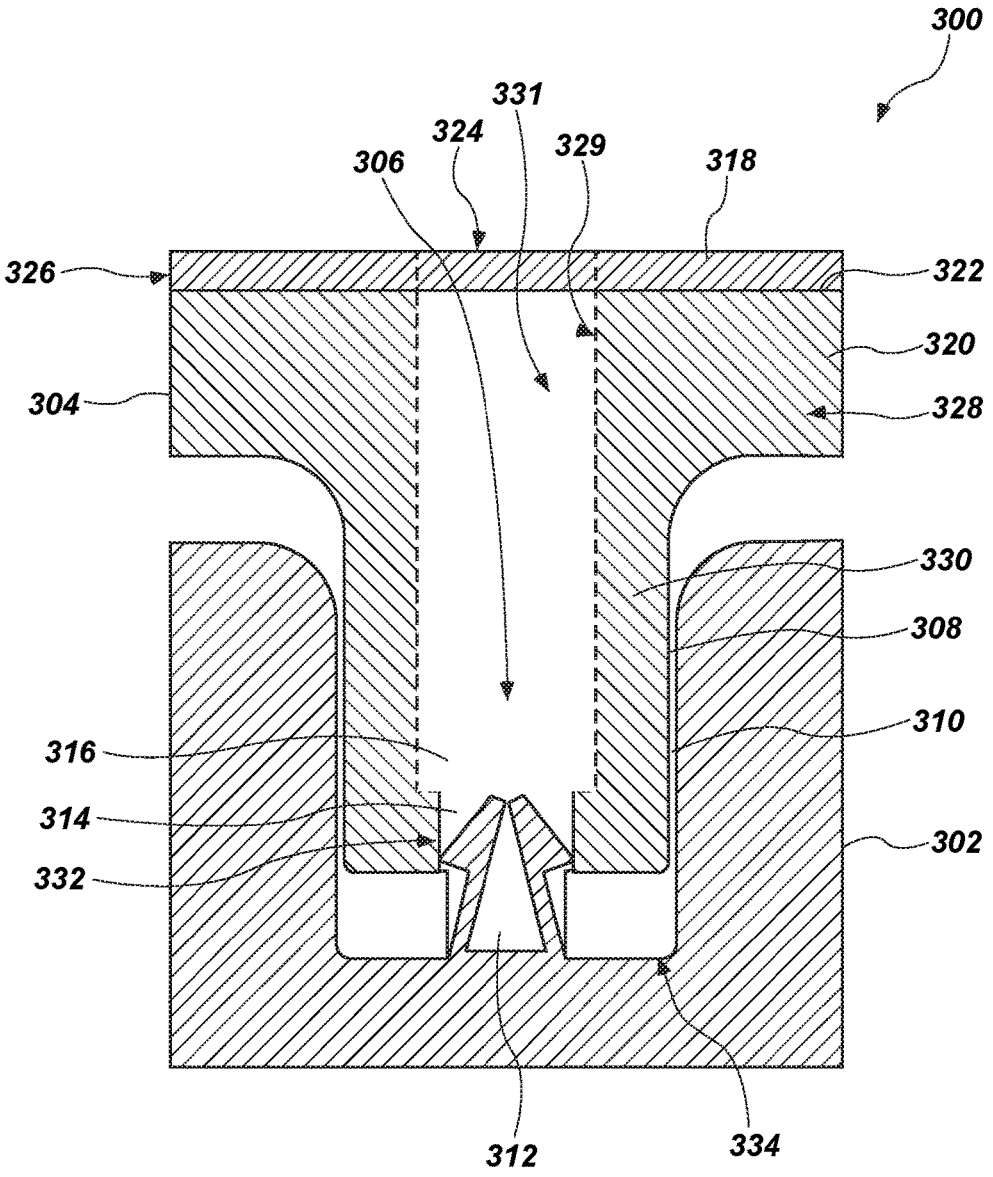

Rotatable cutting elements assemblies as disclosed herein may have certain advantages over conventional fixed cutting elements. For example, sleeves may be installed into a bit body (e.g., by brazing) before the rotatable cutting elements are installed into the sleeves. Thus, the rotatable cutting elements, and particularly the PDC tables, need not be exposed to the high temperatures typical of brazing. Thus, installing rotatable cutting elements into sleeves already secured to a bit body may avoid thermal damage caused by brazing. Furthermore, rotatable cutting elements as disclosed herein may be removed easily and replaced, such as when the cutting elements are worn or damaged. Separation of a rotatable cutting element from a sleeve secured by retention elements may be trivial in comparison to removal of cutting elements or sleeves brazed into a bit body. For example, the rotatable cutting elements depicted in FIGS. 3A-3C may be removed via a tool (e.g., a cylindrical tool, needle-nose pliers, etc.) inserted into the pin-receiving aperture 331 and causing the protrusions 316 of the pin 312 to move to a retracted position, as shown in FIG. 3C. When the protrusions 316 of the pin 312 are in a retracted position, the rotatable cutting element 304 can easily be pulled off of the sleeve 302. Similarly, insertion of a new cutting element may be effected rapidly and without reheating of the drill bit. For example, the rotatable cutting element 304 can be disposed over the pin 312 with the pin-receiving aperture 331 being aligned with the pin 312, and the rotatable cutting element 304 can be pushed onto the pin 312. Thus, drill bits may be more quickly repaired than drill bits having conventional cutting elements.

Moreover, by allowing the rotatable cutting elements to rotate passively, the rotatable cutting elements may passively utilize more of the cutting surfaces thereof without requiring any direct (e.g., forced) rotation by an operator. For example, when a rotatable cutting element is subjected to an external force at least partially tangential to an axis of rotation of the rotatable cutting element, the rotatable cutting element may rotate by some degree and may provide at least some different portion of the cutting surface to be utilized in cutting formations. As a result, the cutting assemblies of the present disclosure may provide rotatable cutting elements that may wear more uniformly around the cutting surface. Accordingly, the cutting assemblies of the present disclosure may require less maintenance during use.

Figure 4B:
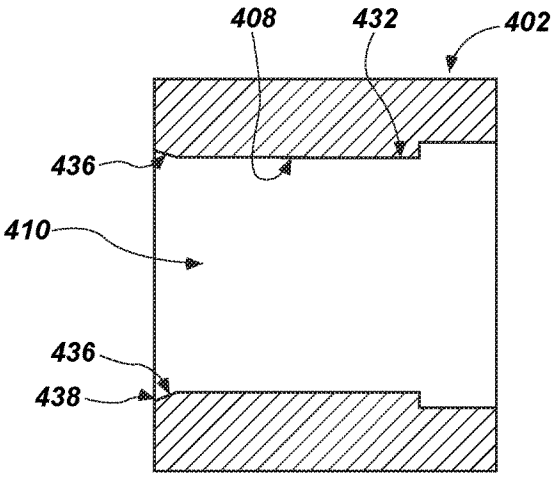
FIG. 4B is a side cross-sectional view of a sleeve of a cutting element assembly according to one or more embodiments of the present disclosure.
Figure 4A:
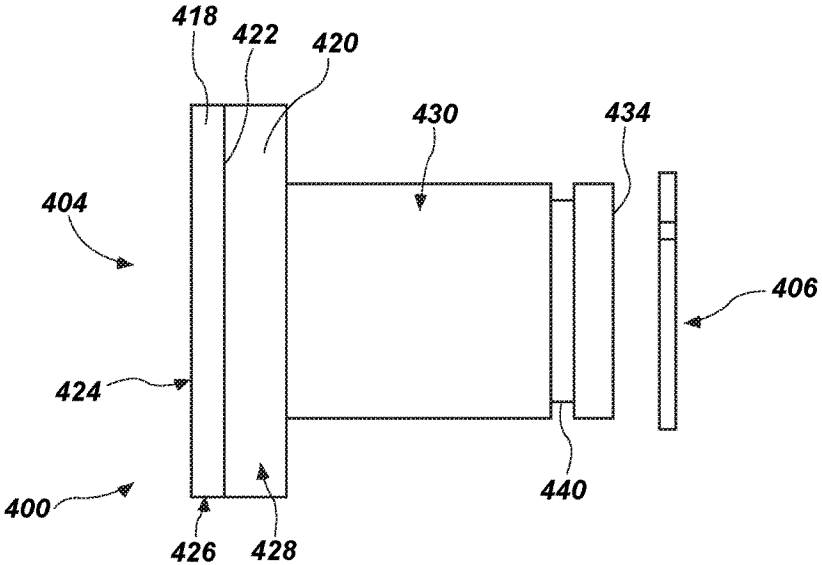
FIG. 4A is a side view of a rotatable cutting element according to one or more embodiments of the present disclosure.
Figure 4C:
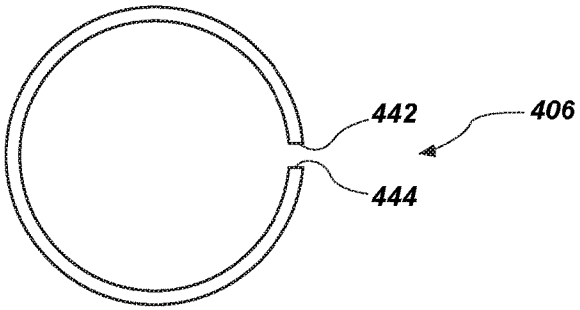
FIG. 4C is a top view of a retention element for rotatably coupling a rotatable cutting element to a sleeve of a cutting element assembly according to one or more embodiments of the present disclosure.

FIG. 4A shows a side view of a rotatable cutting element of a cutting element assembly 400 that can mounted in a blade of an earth-boring tool according to another embodiment of the present disclosure. FIG. 4B shows a side cross-sectional view of a sleeve of the cutting element assembly 400. FIG. 4C shows a top view of a retention element 406 of the cutting element assembly 400. Referring to FIGS. 4A-4C together, similar to the cutting element assembly 300 of FIG. 3A, the cutting element assembly 400 may include a sleeve 402, a rotatable cutting element 404, and a retention element 406.

Furthermore, the sleeve 402 may include a generally cylindrical interior surface 408 defining a cutter-receiving aperture 410 extending at least partially through the sleeve 402. In the embodiments shown in FIG. 4A, for example, the cutter-receiving aperture 410 may extend completely through the sleeve 402. The cutter-receiving aperture 410 may be sized and shaped to receive at least a portion of the rotatable cutting element 304. Furthermore, the interior surface 408 may define a lip 432 extending radially inward from the interior surface 408 (i.e., the inner surface of the cutter-receiving aperture 410). In some instances, the lip 432 may be defined by a transition from a relatively wider portion to a relatively narrower portion of the cutter-receiving aperture 410. In other instances, the lip 432 may include an isolated raised body extending inward around and on the interior surface 408 of the sleeve 402. For example, the lip 432 may include a raised ring extending inward from the interior surface 408 of the sleeve 402.

Moreover, the sleeve 402 may include a guide portion 436 at a longitudinal end of the cutter-receiving aperture 410 of the sleeve 402. In some embodiments, the guide portion 436 may be disposed on a longitudinal end of the cutter-receiving aperture 410 configured (e.g., designed) to receive the rotatable cutting element 404. In some instances, the guide portion 436 may include a chamfered surface extending around an opening edge 438 of the cutter-receiving aperture 410 of the sleeve 402. Put another way, the guide portion 436 may include a frusto-conical surface. Furthermore, upon insertion into the sleeve 402, the guide portion 436 may be shaped to cause the retention element 406 to compress as is described in greater detail below.

As noted above, the cutting element assembly 400 may include a rotatable cutting element 402. Furthermore, the rotatable cutting element 404 may include any configuration of polycrystalline hard material 418 and/or substrate 420 described above in regard to FIG. 3A, for example. Additionally, the polycrystalline hard material 418 may have an end cutting surface 424, and may also have other surfaces, such as a side surface 426, a chamfer, etc., which surfaces may be cutting surfaces intended to contact a subterranean formation. The polycrystalline hard material 418 may be generally cylindrical.

The substrate 420 may include a first generally cylindrical portion 428 proximate the polycrystalline hard material 418 and a second generally cylindrical portion 430 sized and shaped to be inserted into the sleeve 410. In some embodiments, the second generally cylindrical portion 430 may have a smaller outer diameter than the first generally cylindrical portion 428. Additionally, in one or more embodiments, the first generally cylindrical portion 428 may have an outer diameter that is at least substantially the same as an outer diameter of the sleeve 402. The substrate 420 may have a back surface 434 at least substantially parallel to the end cutting surface 424 of the polycrystalline hard material 418 and/or to an interface 422 between the polycrystalline hard material 418 and the substrate 420.

The second generally cylindrical portion 430 of the rotatable cutting element 402 may include a groove 440 extending circumferentially around the second generally cylindrical portion 430 of the rotatable cutting element 404 and extending radially inward from an outer lateral surface of the second generally cylindrical portion 430 of the rotatable cutting element 404. The groove 440 may be sized and configured to receive at least a portion of the retention element 406. For example, the groove 440 may be sized and configured to receive at least a portion of an O-ring, a split ring, a beveled retaining ring, a bowed retaining ring, a spiral retaining ring, or another retaining element. Furthermore, the groove 440 and the lip 432 may be located relative to one another axially along the rotatable cutting element 404 and the sleeve 402, respectively, such that when the rotatable cutting element 404 is inserted into the sleeve 402, the groove 440 may be slidable past the lip 432. Put another way, when the rotatable cutting element 404 is fully inserted into the sleeve 402, the groove 440 may be slid past the lip 432.

As noted above, the cutting element assembly 400 may also include a retention element 406 for rotatably coupling the rotatable cutting element 404 to the sleeve 402. As shown in FIG. 4C, in some embodiments, the retention element 406 may include a split ring. For example, the retention element 406 may have a general C-shape with end portions 442, 444 having a gap defined therebetween. As a result, the retention element 406 may have an extended position and a retracted position. For example, the retention element 406 may be in an extended position when the end portions 442, 444 are separated and have a gap therebetween. On the other hand, the retention element 406 may be in a retracted position when the end portions 442, 444 have a smaller gap therebetween or are contacting each other.

Referring to FIGS. 4A-4C together, when the cutting element assembly 400 is assembled, the second generally cylindrical portion 430 of the rotatable cutting element 404 may be disposed within the generally cylindrical interior surface 408 of the sleeve 302 (i.e., the cutter-receiving aperture 410 of the sleeve 402). Additionally, the first generally cylindrical portion 428 of the rotatable cutting element 404 may be disposed proximate to and overhanging (e.g., protruding over) a longitudinal end of the sleeve 402. Furthermore, when the cutting element assembly 400 is assembled, the retention element 406 may be partially disposed within the groove 440 of the second generally cylindrical portion 430 of the rotatable cutting element 404 and may protrude at least partially from the groove 440 such that the retention element 406 can engage (e.g., contact, abut up against) the lip 432 of the sleeve 402. As a result, the retention element 406 may rotatably couple the rotatable cutting element 404 to the sleeve 402.

Furthermore, referring to FIGS. 4B and 4C together, when the rotatable cutting element 404 is inserted into the sleeve 402 with the retention element 406 (e.g., the split ring) disposed within the groove 440 of the rotatable cutting element 404, the retention element 406 may slide against the guide portion 436 (e.g., the chamfered surface). Additionally, the act of sliding along the guide portion 436 (i.e., sliding along the angled surface of the guide portion 436) may cause the retention element 406 to move (e.g., deform) from extended position to a retracted position. Once the retention element 406 is in the retracted position, the rotatable cutting element 404 may be insertable through the cutter-receiving aperture 410 of the sleeve 402. Moreover, in the retracted position, the retention element 406 may be pushed past the lip 432 of the sleeve 402, and upon passing the lip 432 of the sleeve 402, the retention element 406 may move (e.g., deform) from a retracted position to an extended position.

In some embodiments, an outer diameter of the retention element 406 in an extended position may be determined (e.g., selected) based on an inner diameter of a portion of the cutter-receiving aperture 410 of the sleeve 402 not narrowed by the lip 432 (i.e., a portion of the cutter-receiving aperture 410 of the sleeve 402 past the lip 432). For example, the outer diameter of the retention element 406 in an extended position may be substantially the same as or larger than the inner diameter of the portion of the cutter-receiving aperture 410 of the sleeve 402 not narrowed by the lip 432. Furthermore, a size (e.g., width) of the gap between the end portions 442, 444 may be determined based on a ratio of an inner diameter of the lip 432 of the sleeve 402 and the inner diameter of the portion of the cutter-receiving aperture 410 of the sleeve 402 not narrowed by the lip 432. For example, the size of the gap may be selected in order to allow the retention element 406 to compress into a retracted position having a sufficiently small diameter in order to pass over the lip 432 of the sleeve 402 and in order to allow the retention element 406 to expand into an extended position having a sufficiently large diameter in order to engage the lip 432 of the sleeve 402.

As described above, by engaging the lip 432 of the sleeve 402 and the groove 440 of the rotatable cutting element 404, the retention element 406 may rotatably couple to the rotatable cutting element 304 to the sleeve 402. In particular, the retention element 406 may retain the rotatable cutting element 404 to the sleeve 402 via mechanical interference with the lip 432 of the sleeve 402 and the groove 440 of the rotatable cutting element 304. Furthermore, because the retention element 406 may contact the lip 432 and the groove 440 (i.e., form bearing interfaces), the rotatable cutting element 404 may rotate about an axis collinear with the central longitudinal axis of the sleeve 402. Moreover, in some embodiments, the rotatable cutting element 404 may rotate relative to the sleeve 402 passively. For example, the rotatable cutting element 304 may rotate relative to the sleeve 402 when subjected to an external force (e.g., a force resulting from contacting a formation).

In some embodiments, the back surface 434 and an outer surface of the second cylindrical portion 430 of the substrate 420 and the interior surface 408 of the sleeve 402 may together partially define a void between the substrate 420 and the sleeve 402. This void may prevent compressive longitudinal loads (or longitudinal components of loads) on the rotatable cutting element 404 from being transferred to the sleeve 402 through the interior surface 408 of the sleeve 402 (e.g., because there may not be contact between the interior surface 408 of the sleeve 402 and the back surface 434 or an outer surface of the second cylindrical portion 430 of the substrate 420). Instead, compressive longitudinal loads may be transferred substantially (e.g., entirely or almost entirely) via the bearing interface at which the lip 432 of the sleeve 402 contacts the retention element 406 and via the bearing interface at which the groove 440 of the rotatable cutting element 304 contacts the retention element 406.

Figure 5B:
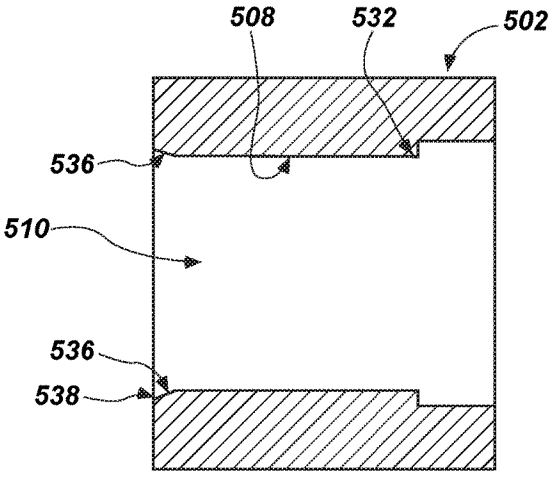
FIG. 5B is a side cross-sectional view of a sleeve of a cutting element assembly according to one or more embodiments of the present disclosure.
Figure 5A:
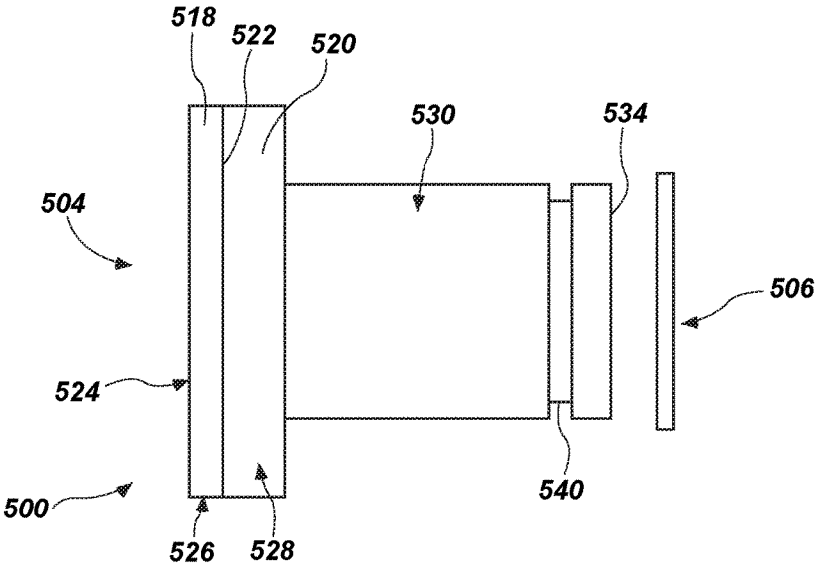
FIG. 5A is a side view of a rotatable cutting element according to one or more embodiments of the present disclosure.
Figure 5C:
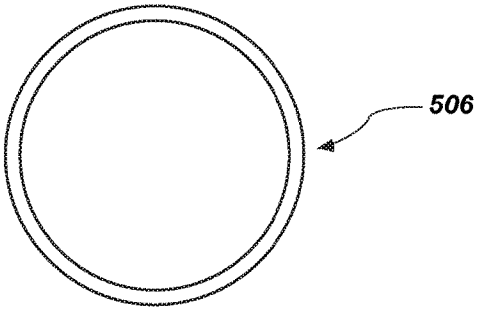
FIG. 5C is a top view of a retention element for rotatably coupling a rotatable cutting element to a sleeve of a cutting element assembly according to one or more embodiments of the present disclosure.

FIGS. 5A-5C show a cutting element assembly 500 according to another embodiment of the present disclosure. The cutting element assembly 500 may be substantially the same as the cutting element assembly 400 shown in FIGS. 4A and 4B. FIGS. 5A-5A depict like numerals to those depicted in FIGS. 4A and 4B (e.g., interior surface 508 is the same as interior surface 408, polycrystalline hard material 518 is the same as polycrystalline hard material 418, etc.). However, a retention element 506 may include an O-ring instead of a split ring.

Moreover, when the rotatable cutting element 504 is inserted into the sleeve 502 with the retention element 506 (e.g., the O-ring) disposed within a groove 540 of the rotatable cutting element 504, the retention element 506 may slide against a guide portion 536 (e.g., the chamfered surface). Furthermore, the act of sliding along the guide portion 536 (i.e., sliding along the angled surface of the guide portion 536) may cause the retention element 406 (e.g., the O-ring) to compress at a molecular level. Once the retention element 406 is in the compressed state, the rotatable cutting element 504 may be insertable through a cutter-receiving aperture 510 of the sleeve 502. Moreover, in the compressed state, the retention element 506 may be pushed past the lip 532 of the sleeve 502, and upon passing the lip 532 of the sleeve 502, the retention element 506 may expand from a compressed state to a normal state.

In some embodiments, an outer diameter of the retention element 506 in a normal state (e.g., not compressed state) may be determined (e.g., selected) based on an inner diameter of a portion of the cutter-receiving aperture 510 of the sleeve 502 not narrowed by the lip 532 (i.e., a portion of the cutter-receiving aperture 510 of the sleeve 502 past the lip 532). For example, the outer diameter of the retention element 506 in a normal state may be substantially the same as the inner diameter of the portion of the cutter-receiving aperture 510 of the sleeve 502 not narrowed by the lip 532. Moreover, the retention element 506 may rotatably couple the rotatable cutting element 504 to the sleeve 502 in the same manner described above in regard to FIGS. 4A-4C.

Figure 6:
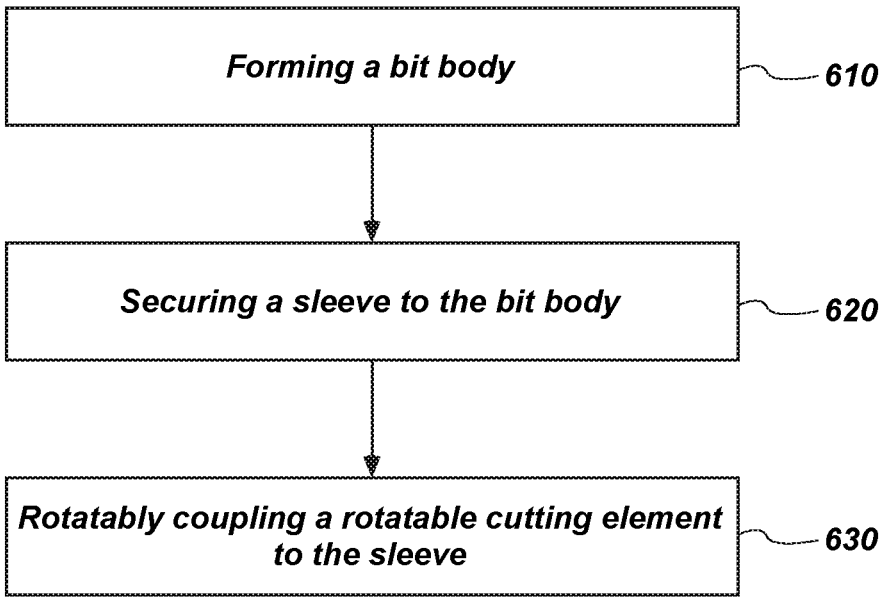
FIG. 6 shows a flow diagram of a method of forming a downhole tool according to one or more embodiments of the present disclosure.

FIG. 6 shows a flow diagram of a method 600 of forming a downhole tool according to one or more embodiments of the present disclosure. In some embodiments, the method can include an act 610 of forming a bit body or a reamer body. For example, act 610 may include forming a bit body that includes at least one blade extending from the bit body. Moreover, the bit body can be formed according to any of the manners described above in regard to FIG. 2. For instance, forming a bit body may include forming a fixed-cutter earth-boring rotary drill bit.

Additionally, the method 600 can include an act 620 of securing a sleeve to the bit body. For example, act 620 can include securing at least one sleeve to the at least one blade, and the sleeve may define a cutter-receiving aperture. For instance, the sleeve can include any of the sleeves described above in regard to FIGS. 3A, 4B, and 5B. Furthermore, in some embodiments, the sleeve can be secured to the bit body via brazing or welding. For example, the sleeve may be brazed and/or welded within a pocket of the bit body.

Moreover, the method 600 can include an act 630 of rotatably coupling a rotatable cutting element to the sleeve. For example, act 630 may include rotatably coupling the rotatable cutting element within the cutter-receiving aperture of the at least one sleeve with a retention element. Furthermore, in some embodiments, act 630 may include inserting a pin (e.g., the pin 312 described above in regard to FIGS. 3A and 3B) into a pin-receiving aperture of the rotatable cutting element and causing at least one protrusion radially extending from a longitudinal end portion of the pin opposite the base portion of the sleeve to move to from a retracted position to an extended position within the receiving aperture of the rotatable cutting element. Additionally, act 630 may include causing the at least one protrusion to engage a lip portion of the rotatable cutting element.

In other embodiments, act 630 may include disposing a retention element (e.g., a split ring or O-ring) within a groove of the rotatable cutting element and inserting the rotatable cutting element into the cutter-receiving aperture of the at least one sleeve. Furthermore, act 630 may include causing the retention element to at least partially compress (e.g., move to a retracted position) via a chamfered surface of the at least one sleeve and inserting the rotatable cutting element into the cutter-receiving aperture of the at least one sleeve until the retention element is pushed past a lip of the at least one sleeve and at least partially expands (e.g., moves to an extended position).

Additional non limiting example embodiments of the disclosure are described below.

Embodiment 1

A cutter assembly for a downhole tool, comprising: a rotatable cutting element; a sleeve having a cutter receiving aperture extending at least partially through the sleeve and configured to receive at least a portion of the rotatable cutting element within the cutter-receiving aperture; and a retention element rotatably coupling the rotatable cutting element to the sleeve.

Embodiment 2

The cutter assembly of embodiment 1, wherein the rotatable cutting element comprises a passive rotatable cutting element.

Embodiment 3

The cutter assembly of embodiment 1, wherein retention element comprises: a pin extending from a base portion of the sleeve and along a central longitudinal axis of the cutter-receiving aperture, the pin comprising at least one resilient portion; and at least one protrusion radially extending outward from a longitudinal end portion of the pin opposite the base portion of the sleeve, wherein the at least one resilient portion is configured to allow movement of the protrusion between an extended position and a retracted position.

Embodiment 4

The cutter assembly of embodiment 3, wherein the rotatable cutting element comprises: a pin-receiving aperture extending at least partially through the rotatable cutting element and for receiving the pin and the at least one protrusion; and a lip extending radially inward from an inner surface of the pin-receiving aperture and sized and shaped to engage the at least one protrusion of the retention element and to rotatably couple the rotatable cutting element to the sleeve.

Embodiment 5

The cutter assembly of embodiment 1, wherein the retention element comprises a split ring.

Embodiment 6

The cutter assembly of embodiment 5, wherein the rotatable cutting element comprises a groove extending circumferentially around the rotatable cutting element and extending radially inward from an outer lateral surface of the rotatable cutting element, wherein the groove is sized and shaped to receive at least a portion of the split ring.

Embodiment 7

The cutter assembly of embodiment 6, wherein sleeve comprises a lip portion extending radially inward from an inner surface of the sleeve and being sized and shaped to engage the split ring and rotatably couple the rotatable cutting element to the sleeve.

Embodiment 8

The cutter assembly of embodiment 1, wherein the sleeve comprises a guide portion at a longitudinal end of the cutter-receiving aperture of the sleeve, the guide portion comprising a chamfered surface extending around an opening edge of the cutter-receiving aperture of the sleeve and shaped to cause the split ring to compress when the rotatable cutting element is inserted into the sleeve.

Embodiment 9

A downhole tool, comprising: a bit body; at least one blade extending from the bit body; at least one sleeve secured to the at least one blade and defining a cutter-receiving aperture; at least one rotatable cutting element disposed within the cutter-receiving aperture of the at least one sleeve; and a retention element rotatably coupling the rotatable cutting element to the at least one sleeve.

Embodiment 10

The drill bit of embodiment 9, wherein the rotatable cutting element passively rotates relative to the at least one sleeve.

Embodiment 11

The drill bit of embodiment 9, wherein the retention element comprises a split ring, and wherein the rotatable cutting element comprises a groove circumferentially extending around the rotatable cutting element, the groove being sized and shaped to receive at least a portion of the split ring.

Embodiment 12

The drill bit of embodiment 11, wherein the at least one sleeve comprises a lip portion extending radially inward from an inner surface of the at least one sleeve and being sized and shaped to engage the split ring and to rotatably couple the rotatable cutting element to the at least one sleeve.

Embodiment 13

The drill bit of embodiment 9, wherein the at least one sleeve is brazed to the bit body within a pocket of the at least one blade.

Embodiment 14

The drill bit of embodiment 9, wherein the rotatable cutting element is cylindrical and rotatable about its central longitudinal axis.

Embodiment 15

The drill bit of embodiment 9, wherein retention element comprises: a pin extending from a base portion of the at least one sleeve and along a central longitudinal axis of the at least one sleeve, the pin comprising at least one resilient portion; and at least one protrusion radially extending from a longitudinal end portion of the pin opposite the base portion of the at least one sleeve and configured to allow movement of the protrusion between an extended position and a retracted position, and wherein the rotatable cutting element comprises: a pin-receiving aperture extending at least partially through the rotatable cutting element and configured for receiving the pin and the at least one protrusion; and a lip extending radially inward from an inner surface of the pin-receiving aperture and sized and shaped to engage the at least one protrusion of the retention element and to rotatably couple the rotatable cutting element to the sleeve.

Embodiment 16

A method of forming a downhole tool, comprising: forming a bit body that includes at least one blade extending from the bit body; securing at least one sleeve to the at least one blade, the sleeve defining a cutter-receiving aperture; and rotatably coupling a rotatable cutting element within the cutter-receiving aperture of the at least one sleeve with a retention element.

Embodiment 17

The method of embodiment 16, wherein rotatably coupling the rotatable cutting element within the at least one sleeve comprises: disposing the retention element comprising a split ring within a groove of the rotatable cutting element; inserting the rotatable cutting element into the cutter-receiving aperture of the at least one sleeve; causing the split ring to at least partially compress via a guide portion of the at least one sleeve; and inserting the rotatable cutting element into the cutter-receiving aperture of the at least one sleeve until the split ring is pushed past a lip of the at least one sleeve and at least partially expands.

Embodiment 18

The method of embodiment 17, wherein causing the split ring to at least partially compress via a chamfered surface comprises: sliding the split ring against the guide portion; and causing the split ring to move from an extended position to a retracted position.

Embodiment 19

The method of embodiment 16, wherein rotatably coupling the rotatable cutting element within the at least one sleeve comprises: inserting a pin extending from a base portion of the at least sleeve into a pin-receiving aperture of the rotatable cutting element; causing at least one protrusion radially extending from a longitudinal end portion of the pin opposite the base portion of the sleeve to move to from a retracted position to an extended position within the receiving aperture of the rotatable cutting element; and causing the at least one protrusion to engage a lip portion of the rotatable cutting element.

Embodiment 20

The method of embodiment 19, wherein inserting the pin into the pin-receiving aperture of the rotatable cutting element comprises causing the at least one protrusion to move from an extended position to a retracted position.

While the present invention has been described herein with respect to certain illustrated embodiments, those of ordinary skill in the art will recognize and appreciate that it is not so limited. Rather, many additions, deletions, and modifications to the illustrated embodiments may be made without departing from the scope of the invention as claimed, including legal equivalents thereof. In addition, features from one embodiment may be combined with features of another embodiment while still being encompassed within the scope of the invention as contemplated by the inventors. Further, embodiments of the disclosure have utility with different and various tool types and configurations.

What is claimed is:

1. A cutter assembly for a downhole tool, comprising:

a rotatable cutting element;

a sleeve having a cutter-receiving aperture extending at least partially through the sleeve and configured to receive at least a portion of the rotatable cutting element within the cutter-receiving aperture; and a retention element rotatably coupling the rotatable cutting element to the sleeve, the retention element comprising:

a pin extending from a base portion of the sleeve and along a central longitudinal axis of the cutter-receiving aperture, the pin comprising at least one resilient portion; and at least one protrusion radially extending outward from a longitudinal end portion of the pin opposite the base portion of the sleeve, wherein the at least one resilient portion is configured to allow movement of the at least one protrusion between an extended position and a retracted position.

2. The cutter assembly of claim 1, wherein the rotatable cutting element comprises a passive rotatable cutting element.

3. The cutter assembly of claim 1, wherein the rotatable cutting element comprises:

a pin-receiving aperture extending at least partially through the rotatable cutting element and for receiving the pin and the at least one protrusion; and a lip extending radially inward from an inner surface of the pin-receiving aperture and sized and shaped to engage the at least one protrusion of the retention element and to rotatably couple the rotatable cutting element to the sleeve.

4. The cutter assembly of claim 3, wherein the lip comprises a transition from a wider portion of the pin-receiving aperture to a narrower portion of the pin-receiving aperture.

5. The cutter assembly of claim 3, wherein the lip comprises an isolated raised body extending around and on an interior surface of the pin-receiving aperture.

6. The cutter assembly of claim 1, wherein the sleeve comprises a guide portion at a longitudinal end of the cutter-receiving aperture of the sleeve, the guide portion comprising a chamfered surface extending around an opening edge of the cutter-receiving aperture of the sleeve and shaped to cause the retention element to compress when the rotatable cutting element is inserted into the sleeve.

7. The cutter assembly of claim 1, wherein the at least one protrusion has a truncated-triangle cross-sectional shape.

8. The cutter assembly of claim 1, wherein the pin comprises a collet fastener.

9. The cutter assembly of claim 1, wherein the pin comprises at least four resilient portions.

10. A downhole tool, comprising:

a bit body;

at least one blade extending from the bit body;

at least one sleeve secured to the at least one blade and defining a cutter-receiving aperture;

at least one rotatable cutting element disposed within the cutter-receiving aperture of the at least one sleeve; and a retention element rotatably coupling the at least one rotatable cutting element to the at least one sleeve, the retention element comprising:

a pin extending from a base portion of the sleeve and along a central longitudinal axis of the cutter-receiving aperture, the pin comprising at least one resilient portion; and at least one protrusion radially extending outward from a longitudinal end portion of the pin opposite the base portion of the sleeve, wherein the at least one resilient portion is configured to allow movement of the at least one protrusion between an extended position and a retracted position.

11. The downhole tool of claim 10, wherein the at least one rotatable cutting element passively rotates relative to the at least one sleeve.

12. The downhole tool of claim 10, wherein the at least one sleeve is brazed to the bit body within a pocket of the at least one blade.

13. The downhole tool of claim 10, wherein the at least one rotatable cutting element is cylindrical and rotatable about its central longitudinal axis.

14. The downhole tool of claim 10, wherein the at least one rotatable cutting element comprises:

a pin-receiving aperture extending at least partially through the at least one rotatable cutting element and configured for receiving the pin and the at least one protrusion; and a lip extending radially inward from an inner surface of the pin-receiving aperture and sized and shaped to engage the at least one protrusion of the retention element and to rotatably couple the at least one rotatable cutting element to the at least one sleeve.

15. The downhole tool of claim 10, wherein the at least one protrusion has a truncated-triangle cross-sectional shape.

16. The downhole tool of claim 10, wherein the pin comprises a collet fastener.

17. The downhole tool of claim 10, wherein the pin comprises at least four resilient portions.

18. The downhole tool of claim 10, wherein the lip comprises a transition from a wider portion of the pin-receiving aperture to a narrower portion of the pin-receiving aperture.

19. A method of forming a downhole tool, comprising:

forming a bit body that includes at least one blade extending from the bit body;

securing at least one sleeve to the at least one blade, the at least one sleeve defining a cutter-receiving aperture; and rotatably coupling a rotatable cutting element within the cutter-receiving aperture of the at least one sleeve with a retention element by:

inserting a pin extending from a base portion of the at least one sleeve into a pin-receiving aperture of the rotatable cutting element;

causing at least one protrusion radially extending from a longitudinal end portion of the pin opposite the base portion of the at least one sleeve to move to from a retracted position to an extended position within the pin-receiving aperture of the rotatable cutting element; and causing the at least one protrusion to engage a lip portion of the rotatable cutting element.

20. The method of claim 19, wherein inserting the pin into the pin-receiving aperture of the rotatable cutting element comprises causing the at least one protrusion to move from an extended position to a retracted position.

* * * * *